US010865799B2

(12) United States Patent
Yamashita et al.

(10) Patent No.: US 10,865,799 B2
(45) Date of Patent: Dec. 15, 2020

(54) CENTRIFUGAL COMPRESSION TEST DEVICE

(71) Applicant: MITSUBISHI HEAVY INDUSTRIES COMPRESSOR CORPORATION, Tokyo (JP)

(72) Inventors: Shuichi Yamashita, Tokyo (JP); Akihiro Nakaniwa, Tokyo (JP); Masahiro Ishikawa, Tokyo (JP); Yoshiaki Shoji, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 79 days.

(21) Appl. No.: 16/079,209

(22) PCT Filed: Mar. 15, 2017

(86) PCT No.: PCT/JP2017/010387

§ 371 (c)(1),
(2) Date: Aug. 23, 2018

(87) PCT Pub. No.: WO2017/159729

PCT Pub. Date: Sep. 21, 2017

(65) Prior Publication Data

US 2019/0032670 A1 Jan. 31, 2019

(30) Foreign Application Priority Data

Mar. 18, 2016 (JP) ..... 2016-056046

(51) Int. Cl.
*F04D 27/00* (2006.01)
*F04D 29/44* (2006.01)
(Continued)

(52) U.S. Cl.
CPC ..... *F04D 27/001* (2013.01); *F04D 17/12* (2013.01); *F04D 29/4213* (2013.01); *F04D 29/444* (2013.01); *F05D 2250/51* (2013.01)

(58) Field of Classification Search
CPC .... F04D 27/001; F04D 27/002; F04D 27/003; F04D 27/0238; F04D 29/70;
(Continued)

(56) References Cited

U.S. PATENT DOCUMENTS 4,725,196 A * 2/1988 Kaneki ..... F04D 29/104 415/100
6,293,103 B1 * 9/2001 Gladden ..... F02B 33/446 60/612
(Continued)

FOREIGN PATENT DOCUMENTS

JP S58-096197 A 6/1983
JP 2001-116652 A 4/2001
(Continued)

OTHER PUBLICATIONS

Extended European Search Report for corresponding European Patent Application No. 17766725.0, dated Jan. 17, 2019 (8 pages).
(Continued)

*Primary Examiner* — Nathaniel E Wiehe
*Assistant Examiner* — Jackson N Gillenwaters
(74) *Attorney, Agent, or Firm* — Osha Bergman Watanabe & Burton LLP

(57) ABSTRACT

A centrifugal compression test device includes a flow path forming section and an inlet space forming section. The flow path forming section forms an introduction flow path, an inlet flow path, and an interstage inflow path. The introduction flow path guides a fluid from the outside toward the inside in the radial direction. The inlet flow path is connected to the introduction flow path. The interstage inflow path extends from the outside toward the inside in the radial direction and is connected to the inlet flow path. The inlet space forming section is formed an annular shape having an introduction opening section through which a fluid is introduced from a part in the circumferential direction and the outside in the radial direction at the first side of the introduction flow path. Further, a front end of the introduction flow path is connected to the inlet space forming section.

7 Claims, 3 Drawing Sheets

(51) Int. Cl.
*F04D 29/42* (2006.01)
*F04D 17/12* (2006.01)

(58) Field of Classification Search
CPC ..... F04D 29/701; F04D 17/12; F04D 17/122; F05D 2250/51; F05D 2250/511; F05D 2250/512
See application file for complete search history.

(56) References Cited

U.S. PATENT DOCUMENTS

| | | | | |
|---|---|---|---|---|
| 2007/0140889 | A1 | 6/2007 | Chen et al. | |
| 2016/0281601 | A1* | 9/2016 | Sirinivasan | F01D 25/24 |
| 2018/0073512 | A1* | 3/2018 | Nissler | F04D 25/163 |

FOREIGN PATENT DOCUMENTS

| | | | | |
|---|---|---|---|---|
| JP | 2007-309154 A | | 11/2007 | |
| JP | 2007309154 | * | 11/2007 | F04D 29/4213 |
| JP | 2010-285927 A | | 12/2010 | |
| JP | 2013-194687 A | | 9/2013 | |
| JP | 2014-137008 A | | 7/2014 | |

OTHER PUBLICATIONS

International Search Report for corresponding International Application No. PCT/JP2017/010387, dated Jun. 6, 2017 (4 pages).
Written Opinion for corresponding International Application No. PCT/JP2017/010387, dated Jun. 6, 2017 (11 pages).
M. Yagi et al.; "Optimization of Suction Channel for Improving Performance of Process Centrifugal Compressor"; Turbomachinery, vol. 38, No. 8, pp. 8-15; May 31, 2013 (8 pages).
Y. Fukushima et al,. "Rotating Stall of Centrifugal Compressors"; Turbomachinery, vol. 17, No. 3, pp. 27-37; Jul. 11, 2011 (11 pages).
M. Miya et al.; "Effect of Injection Nozzle Shape on Performance Characterestics of a Centrifugal Compressor"; Turbomachinery, vol. 41, No. 2, pp. 8-13; Turbomachinery Society of Japan; May 10, 2015 (6 pages).

* cited by examiner

CENTRIFUGAL COMPRESSION TEST DEVICE

TECHNICAL FIELD

The present invention relates to a centrifugal compression test device.

Priority is claimed on Japanese Patent Application No. 2016-056046, filed Mar. 18, 2016, the content of which is incorporated herein by reference.

BACKGROUND ART

A uniaxial multistage centrifugal compressor in which a plurality of impellers are installed on the same rotary shaft to boost a fluid by stages is known. In such a uniaxial multistage centrifugal compressor, so-called interstage inflow in which a working fluid obtained by extracting a fluid inserted from the outside or a fluid boosted by a rear stage impeller flows into an inflow port through which a working fluid flows into the impellers may be performed.

Patent Document 1 discloses that, in a two-stage centrifugal compressor, in order to additionally supply a gas, an interstage inflow path is formed.

CITATION LIST

Patent Literature

Patent Document 1

Japanese Unexamined Patent Application, First Publication No. 2013-194687

SUMMARY OF INVENTION

Technical Problem

For example, in the above-mentioned uniaxial multistage centrifugal compressor, in general, performance prediction is performed based on a verification test result by a single stage test device. For this reason, even when performance prediction is performed based on a verification test by a single stage test device in which interstage inflow is not provided, reliability of the prediction result may be low. In addition, in a multistage centrifugal compressor having interstage inflow, the interstage inflow is mainly disposed in an inflow port of an impeller at second and subsequent stages. For this reason, even when a single stage test device in which interstage inflow is formed is devised, the same conditions as in a real machine may not be obtained.

The present invention is directed to providing a centrifugal compression test device capable of improving performance prediction accuracy by performing a verification test having high reliability on a single stage impeller when performance prediction of a centrifugal compressor having interstage inflow is performed.

Solution to Problem

According to a first aspect of the present invention, a centrifugal compression test device includes a rotary shaft, a bearing, a driving source, an impeller, a flow path forming section and an inlet space forming section. The rotary shaft extends in an axial direction. The bearing rotatably supports the rotary shaft about an axis thereof. The driving source drives the rotary shaft around the axis. The impeller is fixed to an outer circumferential surface of the rotary shaft and configured to pump a fluid flowing from a first side in an axial direction to an outside in a radial direction while rotating together with the rotary shaft. The flow path forming section forms an introduction flow path, an inlet flow path and an interstage inflow path. The introduction flow path guides a fluid from the outside in the radial direction toward the inside in the radial direction at the first side of the impeller in the axial direction. The inlet flow path is connected to the introduction flow path and configured to guide the fluid to the impeller from the first side in the axial direction. The interstage inflow path extends from the outside toward the inside in the radial direction and is connected to the inlet flow path at a second side of the introduction flow path in the axial direction. The inlet space forming section has an introduction opening section through which a fluid is introduced from a part in the circumferential direction and outside in the radial direction at the first side of the introduction flow path in the axial direction. The inlet space forming section further forms an annular shape about the axis, and a front end of the introduction flow path is connected to the inlet space forming section.

According to the above-mentioned configuration, under the same condition as in a real machine including an interstage inflow path, an intermediate stage including the interstage inflow path can be simulated and a verification test by a single stage test device can be performed. As a result, performance prediction accuracy can be improved.

According to a second aspect of the present invention, in the first aspect, the centrifugal compression test device may include a pressure loss application unit configured to apply a pressure loss to a fluid flowing into the introduction flow path.

According to the above-mentioned configuration, since a pressure loss can be applied to the fluid flowing into the introduction flow path using the pressure loss application unit, a flow rate of the fluid flowing into the introduction flow path can be uniformized in the circumferential direction. As a result, an environment similar to a real machine can be created.

According to a third aspect of the present invention, in the centrifugal compression test device in the second aspect, the pressure loss application unit may be installed at only a side closer to the introduction opening section than the axis in the circumferential direction about the axis.

For example, while a flow rate of the fluid increases toward a place close to the introduction opening section in the circumferential direction in the introduction flow path and deviation occurs in the flow rate of the fluid in the circumferential direction, the deviation in the flow rate can be further uniformized by the pressure loss application unit. As a result, an environment more similar to a real machine can be created.

According to a fourth aspect of the present invention, in any one aspect of the first to third aspects, the centrifugal compression test device may include a return flow path forming section and an outlet space forming section. The return flow path forming section forms a return flow path extending inward in the radial direction after extending from the impeller toward the outside in the radial direction. The outlet space forming section through which a fluid is discharged from a part in the circumferential direction and the outside in the radial direction forms an annular shape about the axis at a second side of the return flow path in the axial direction. A rear end of the return flow path is further connected to the outlet space forming section.

According to the above-mentioned configuration, an environment more similar to a real machine can be created even on the second side in the axial direction from the impeller. As a result, reliability in a test result of a verification test by a single stage test device can be improved.

Advantageous Effects of Invention

According to the centrifugal compression test device, when performance prediction of the centrifugal compressor having interstage inflow is performed, a verification test having high reliability can be performed on a single stage impeller, and performance prediction accuracy can be improved.

DESCRIPTION OF EMBODIMENTS

Hereinafter, a centrifugal compression test device according to an embodiment of the present invention will be described with reference to the accompanying drawings.

Figure 1:
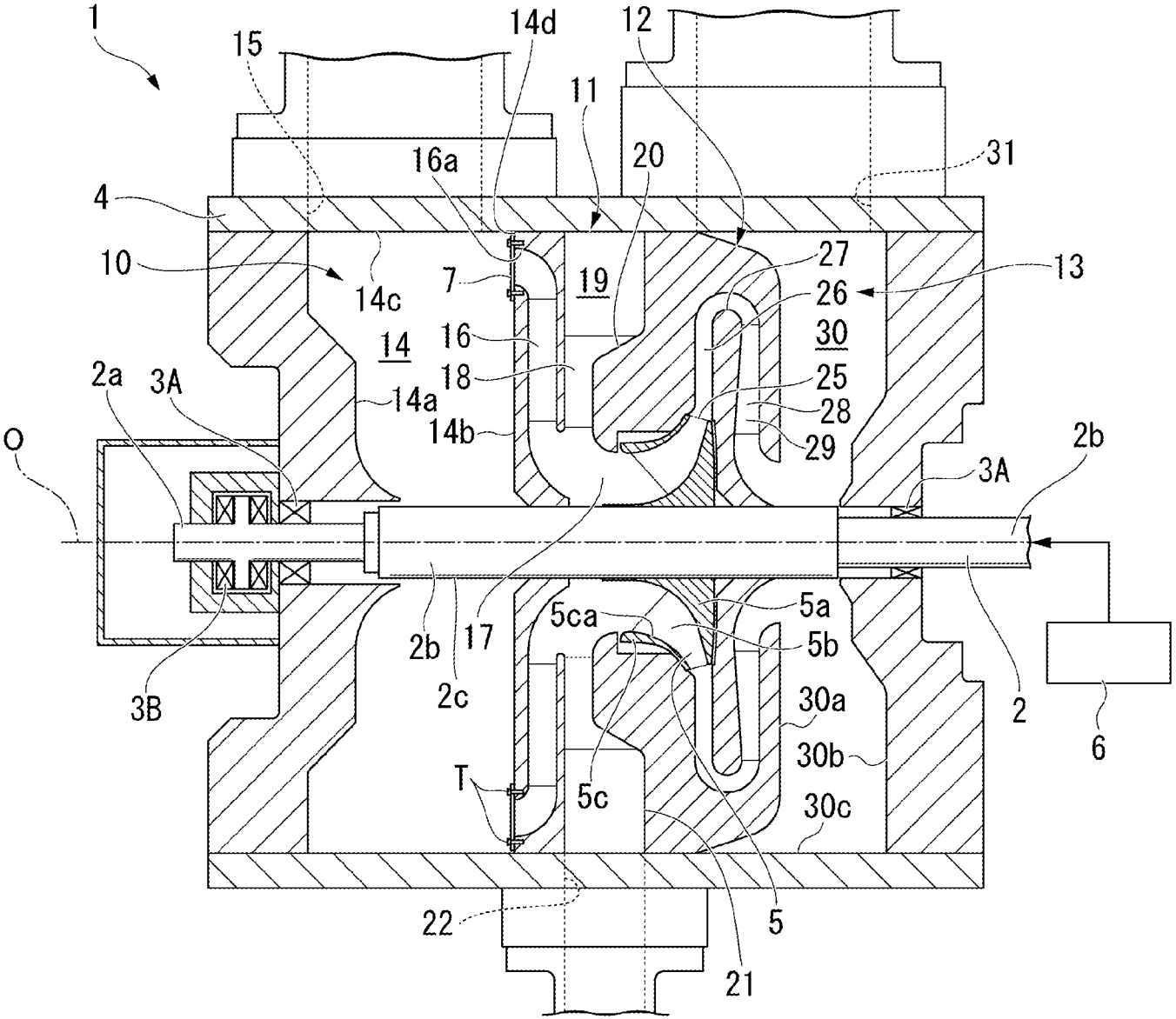
FIG. 1 is a cross-sectional view of a centrifugal compression test device according to an embodiment of the present invention.

FIG. 1 is a cross-sectional view of a centrifugal compression test device according to the embodiment of the present invention.

As shown in FIG. 1, a centrifugal compression test device 1 according to the embodiment includes a rotary shaft 2, bearings 3A and 3B, a casing 4, an impeller 5, a driving source 6 and a pressure loss application unit 7.

The rotary shaft 2 is rotatably supported by the bearings 3A and 3B about an axis O. The bearings 3A and 3B are attached to the casing 4. The bearings 3A and 3B rotatably support the rotary shaft 2 while restricting displacement in a radial direction and an axial direction thereof. The casing 4 supports a first end portion 2*a* and a second end portion 2*b* in an axis O direction of the rotary shaft 2 via the bearings 3A and 3B. The casing 4 accommodates the rotary shaft 2, the impeller 5, and so on.

The casing 4 includes an inlet space forming section 10, a flow path forming section 11, a return flow path forming section 12 and an outlet space forming section 13.

The inlet space forming section 10 is annularly formed about the axis O. The inlet space forming section 10 forms an annular inlet space 14 therein around the rotary shaft 2. The inlet space forming section 10 has an introduction opening section 15 formed in a part thereof in a circumferential direction. A fluid can be introduced into the inlet space 14 from the outside in the radial direction via the introduction opening section 15.

The inlet space 14 in the embodiment is formed by a first side surface 14*a*, a second side surface 14*b*, an inner circumferential surface 14*c*, and an outer circumferential surface 2*c* of the rotary shaft 2.

The first side surface 14*a* is disposed in the inlet space 14 on the side close to the first end portion 2*a* in the axis O direction (a first side in the axial direction). The first side surface 14*a* is formed to be disposed gradually closer to the second end portion 2*b* in the axis O direction as it approaches the rotary shaft 2.

The second side surface 14*b* is disposed in the inlet space 14 on the side close to the second end portion 2*b* (a second side in the axial direction). The second side surface 14*b* is formed mainly on a flat surface perpendicular to the axis O.

The inner circumferential surface 14*c* is disposed about the axis O of the inlet space 14 outside in the radial direction. The inner circumferential surface 14*c* is formed in a cylindrical shape that connects circumferential edges of the first side surface 14*a* and the second side surface 14*b*.

The flow path forming section 11 brings the inlet space 14 and the impeller 5 in communication with each other. The flow path forming section 11 forms an introduction flow path 16, an inlet flow path 17 and an interstage inflow path 18.

The introduction flow path 16 guides a fluid from the outside in the radial direction toward the inside in the radial direction at a side close to the first end portion 2*a* of the impeller 5 in the axis O direction. The introduction flow path 16 has an annular opening section 16*a* (a front end) facing the first end portion 2*a* in the axis O direction in the vicinity of an outer circumferential edge 14*d* of the above-mentioned second side surface 14*b*. The introduction flow path 16 extends linearly inward in the radial direction after being curved from the opening section 16*a* toward the inside in the radial direction about the axis O. Further, the introduction flow path 16 extends linearly inward in the radial direction and then is curved toward the second end portion 2*b* in the axis O direction.

The inlet flow path 17 is connected to the introduction flow path 16 and introduces a fluid into the impeller 5 from the first end portion 2*a* side in the axis O direction. The inlet flow path 17 extends from an end portion of the introduction flow path 16 close to the second end portion 2*b* in the axis O direction toward the impeller 5 along the axis O. The inlet flow path 17 according to the embodiment has a flow path cross-sectional area that is larger than that of the introduction flow path 16.

The interstage inflow path 18 is formed at a side of the introduction flow path 16 close to the second end portion 2*b* in the axis O direction. The interstage inflow path 18 extends from the outside toward the inside in the radial direction about the axis O and is connected to the inlet flow path 17. The interstage inflow path 18 is in communication with an interstage inflow inlet space 19. The interstage inflow inlet space 19 is formed to be wider than the interstage inflow path 18 in the axis O direction. The interstage inflow inlet space 19 of the embodiment has an inclined surface 20 formed on an inner circumferential section about the axis O in the radial direction and extending toward the inside in the radial direction and toward a side close to the first end portion 2*a* in the axis O direction. Accordingly, the interstage inflow inlet space 19 has a width dimension in the axis O direction that gradually decreases as it approaches the axis O.

A portion of the interstage inflow inlet space 19 according to the embodiment closer to an outer circumferential side in the radial direction about the axis O than the inclined surface 20 has a constant width dimension in the axis O direction. The interstage inflow inlet space 19 enables a fluid to be introduced thereinto from the outside in the radial direction via an intermediate introduction opening section 22 formed in a part of an outer circumferential section 21 in the circumferential direction. The intermediate introduction opening section 22 according to the embodiment is formed at a side opposite to the introduction opening section 15 with the axis O interposed therebetween in the circumferential direction. A fluid is supplied at a predetermined flow rate to the interstage inflow inlet space 19 via the intermediate introduction opening section 22 through an external compressor (not shown) or the like.

The return flow path forming section 12 forms a return flow path in communication with an outlet space 30 formed by the outlet space forming section 13 through a flow path outlet 25 outside in the radial direction of the impeller 5. The return flow path forming section 12 includes a diffuser unit 26, a return bend section 27, a straight flow path 28 and a return vane 29.

The diffuser unit 26 guides the fluid compressed by the impeller 5 toward the outside in the radial direction. In the diffuser unit 26, a flow path cross-sectional area gradually increases from the inside in the radial direction toward the outside in the radial direction about the axis O. An end portion, i.e., an outlet of the diffuser unit 26 outside in the radial direction, is connected to the return bend section 27.

The return bend section 27 connects an outlet of the diffuser unit 26 and an inlet of the straight flow path 28. The return bend section 27 is curved in a U shape that protrudes toward the outside in the radial direction about the axis O. That is, as the fluid flows through the return bend section 27, a direction of the flow of the fluid that exits the diffuser unit 26 is varied from the outside in the radial direction to the inside in the radial direction about the axis O.

The straight flow path 28 extends from an end portion, i.e., an outlet downstream from the return bend section 27, toward the inside in the radial direction about the axis O. An end portion (a rear end) of the straight flow path 28 inside in the radial direction is curved toward the second end portion 2*b* in the axis O direction and opens to the outlet space 30.

A plurality of return vanes 29 are formed on the straight flow path 28. The return vanes 29 are radially arranged about the axis O. The fluid flowing through the straight flow path 28 is rectified by the return vanes 29.

The outlet space forming section 13 is formed in an annular shape about the axis O. The outlet space forming section 13 forms the annular outlet space 30 around the rotary shaft 2 of the inside thereof. The outlet space forming section 13 has a discharge opening section 31 formed at a portion thereof in the circumferential direction. The fluid flowing into the outlet space 30 from the straight flow path 28 can be discharged to the outside of the casing 4 via the discharge opening section 31. The discharge opening section 31 according to the embodiment is formed at the same position as the introduction opening section 15 of the inlet space forming section 10 in the circumferential direction about the axis O.

The outlet space 30 according to the embodiment is formed by a first side surface 30*a*, a second side surface 30*b*, an inner circumferential surface 30*c*, and the outer circumferential surface 2*c* of the rotary shaft 2.

The first side surface 30*a* is disposed at a side of the outlet space 30 close to the first end portion 2*a* in the axis O direction. The first side surface 30*a* is formed mainly on a flat surface perpendicular to the axis O. The second side surface 30*b* is disposed on a side of the outlet space 30 close to the second end portion 2*b*. The second side surface 30*b* is formed to be disposed at a side closer to the second end portion 2*b* in the axis O direction by stages as it approaches the rotary shaft 2.

The inner circumferential surface 30*c* is disposed outside in the radial direction about the axis O of the outlet space 30. The inner circumferential surface 30*c* is formed in a cylindrical shape that connects circumferential edges of the first side surface 30*a* and the second side surface 30*b*.

The single (one stage) impeller 5 is disposed in the casing 4 between the inlet flow path 17 and the diffuser unit 26. The impeller 5 is fixed to the outer circumferential surface 2*c* of the rotary shaft 2 through shrinkage fitting or the like. The impeller 5 boosts the fluid flowing from the inlet flow path 17 to send the boosted fluid to the diffuser unit 26. The impeller 5 includes a disk 5*a*, blades 5*b* and a cover 5*c*.

The disk 5*a* is formed in a disk shape about the axis O. More specifically, the disk 5*a* is formed from the first end portion 2*a* side of the rotary shaft 2 in the axis O direction toward the second end portion 2*b* of the rotary shaft 2 such that a diameter gradually increases in the radial direction about the axis O.

The plurality of blades 5*b* are formed at intervals in the circumferential direction of the axis O while being formed on a surface of the disk 5*a* facing the first end portion 2*a* in the axis O direction. The blades 5*b* are radially disposed about the axis O while extending away from the disk 5*a*.

The cover 5*c* covers the plurality of blades 5*b* from the first end portion 2*a* side in the axis O direction. In other words, the cover 5*c* is formed to oppose the disk 5*a* having the blades 5*b* interposed therebetween. An inner circumferential surface 5*ca* of the cover 5*c* is formed such that a diameter thereof decreases from the second end portion 2*b* side in the axis O direction toward the first end portion 2*a*. The above-mentioned blades 5*b* extend from the inner circumferential surface 5*ca* toward the disk 5*a*.

The driving source 6 rotates the rotary shaft 2. The driving source 6 includes, for example, an electric motor, an internal combustion engine, or the like configured to generate rotational energy. The driving source 6 includes a transmission mechanism such as a speed reducer or the like configured to transmit rotation of the electric motor or the internal combustion engine to the rotary shaft 2. The rotary shaft 2 can be rotated by the driving source 6 at a desired speed.

Figure 2:
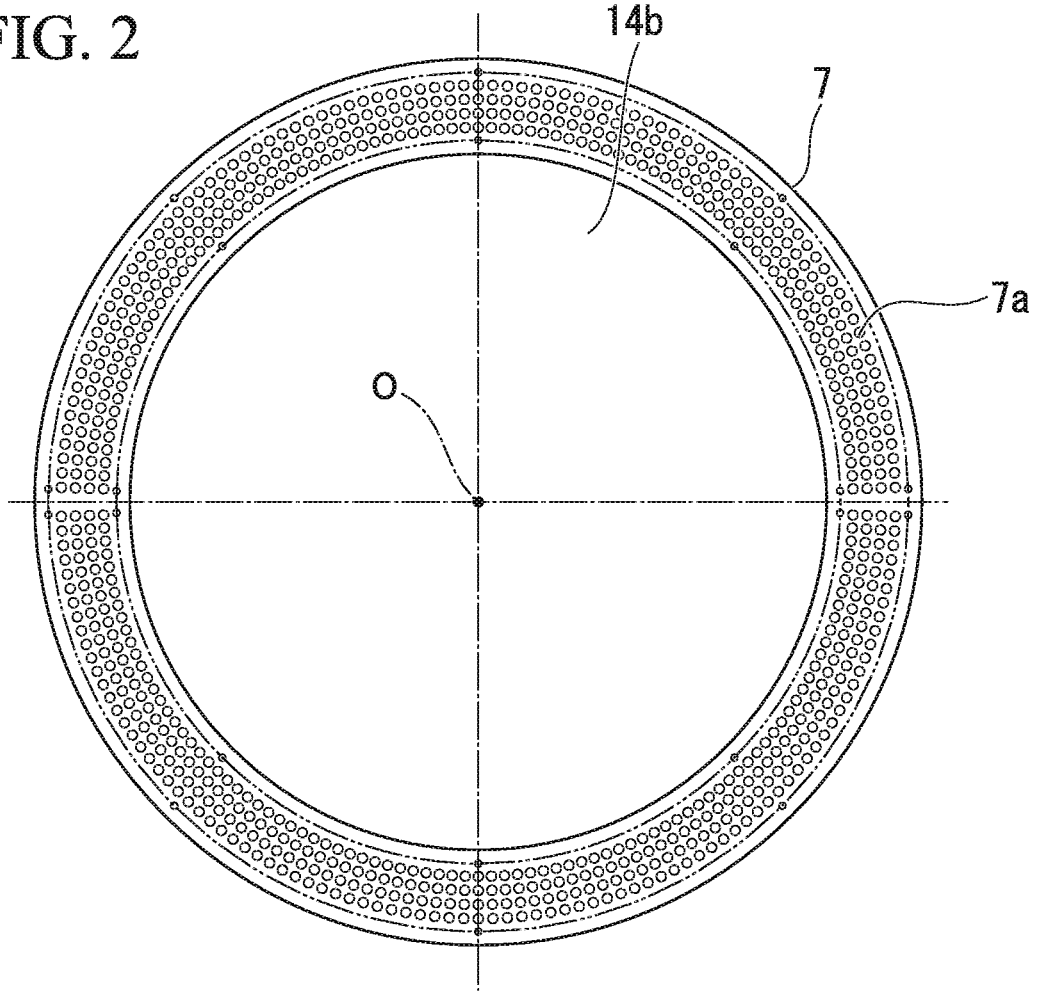
FIG. 2 is a front view of a pressure loss application unit according to the embodiment of the present invention.

FIG. 2 is a front view of a pressure loss application unit according to the embodiment of the present invention.

As shown in FIGS. 1 and 2, the pressure loss application unit 7 is attached to the opening section 16*a* of the introduction flow path 16.

The pressure loss application unit 7 provides a pressure loss with respect to the fluid flowing from the inlet space 14 to the introduction flow path 16. The pressure loss application unit 7 according to the embodiment is formed of a punching metal. The pressure loss application unit 7 is formed in an annular shape to cover the opening section 16*a*. Through-holes 7*a* of the punching metal formed in the pressure loss application unit 7 are formed such that the pressure loss is uniformized in the circumferential direction about the axis O.

While the case in which the pressure loss application unit 7 is formed of the punching metal has been described here, the material is not limited to the punching metal as long as the pressure loss is capable of being applied. For example, the shape may be a mesh shape or a slit shape. In addition, the pressure loss application unit 7 according to the embodiment is formed to be slightly wider than the opening section 16*a*, and fixed to the second side surface 14*b* of the circumferential edge portion of the opening section 16*a* from the inlet space 14 side in the axis O direction. The pressure loss application unit 7 is fixed at a plurality of places of the opening section 16*a* in the circumferential direction by fastening members T such as screws (see FIG. 1).

According to the centrifugal compression test device of the above-mentioned embodiment, under the same conditions as in the real machine including the interstage inflow path, the verification test by the single stage test device can be performed by simulating the intermediate stage including the interstage inflow path. As a result, performance prediction accuracy can be improved.

In addition, since the pressure loss can be applied to the fluid flowing into the introduction flow path 16 by the pressure loss application unit 7, a flow rate of the fluid flowing into the introduction flow path 16 can be uniformized in the circumferential direction. As a result, an environment similar to the intermediate stage of the real machine can be created using the single stage test device.

Further, since the return flow path forming section 12 and the outlet space forming section 13 are provided, even at the side closer to the second end portion 2*b* in the axis O direction than the impeller 5, an environment similar to the intermediate stage of the real machine including the interstage inflow path 18 can be created. As a result, reliability in the test result of the verification test by the single stage test device can be improved.

Other Modified Examples

The present invention is not limited to the above-mentioned embodiment and various modifications may be made to the above-mentioned embodiment without departing from the scope of the present invention. That is, a specific shape, a configuration, or the like exemplified in the embodiment is merely exemplary and may be appropriately varied.

For example, in the above-mentioned embodiment, a so-called closed impeller in which the impeller 5 includes the cover 5*c* has been exemplarily described. However, the impeller 5 may be a so-called open impeller in which the cover 5*c* is not provided.

Figure 3:
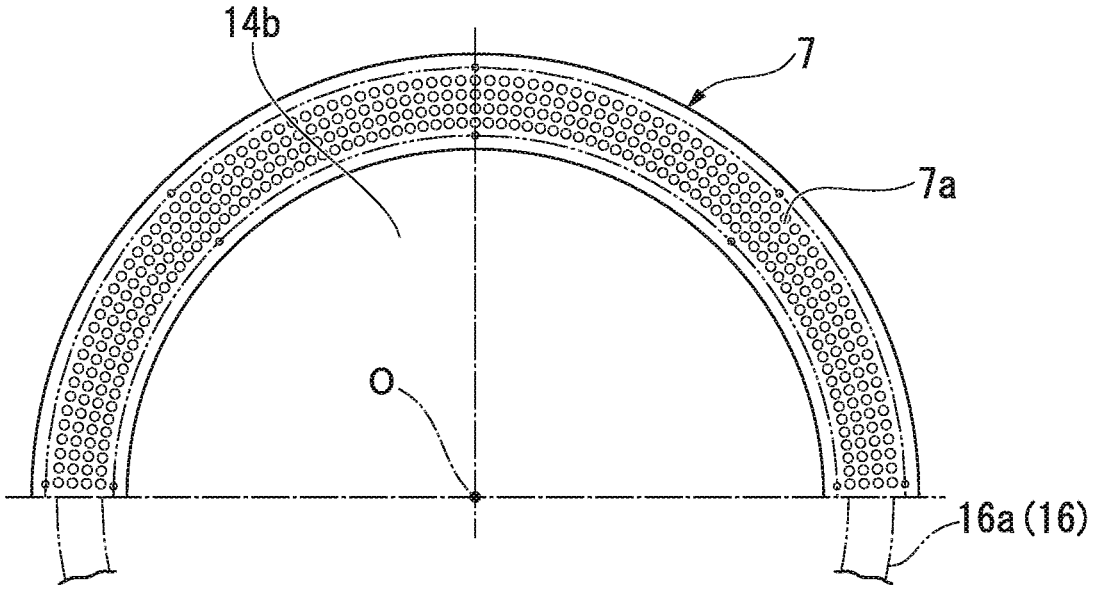
FIG. 3 is a view of a pressure loss application unit according to a modified example of the embodiment of the present invention, corresponding to FIG. 2.

In the above-mentioned embodiment, the case in which the pressure loss application unit 7 is formed throughout the circumference in the circumferential direction about the axis O has been described. However, the pressure loss application unit 7 may be installed at only a place in which a flow rate of the fluid flowing into the opening section 16*a* of the introduction flow path 16 is relatively high. That is, as shown in FIG. 3, the pressure loss application unit 7 may be installed at only a side close to the introduction opening section 15 in the circumferential direction about the axis O. In the example in FIG. 3, the pressure loss application unit 7 is installed in the entire region within a range closer to the introduction opening section 15 than a half in the circumferential direction about the axis O. However, the pressure loss application unit 7 may be installed at only a portion within a range closer to the opening section 16*a* than a half in the circumferential direction about the axis O.

In the above-mentioned embodiment, the case in which the through-holes 7*a* of the punching metal of the pressure loss application unit 7 are uniformly formed in the circumferential direction about the axis O has been described. However, for example, the through-holes 7*a* may be formed smaller toward the introduction opening section 15. That is, the pressure loss application unit 7 may be formed such that the pressure loss increases toward the introduction opening section 15. In addition, the pressure loss application unit 7 may be installed on the introduction opening section 15. That is, the pressure loss application unit 7 may be mounted to block the introduction opening section 15 from the inner circumferential side.

Figure 4:
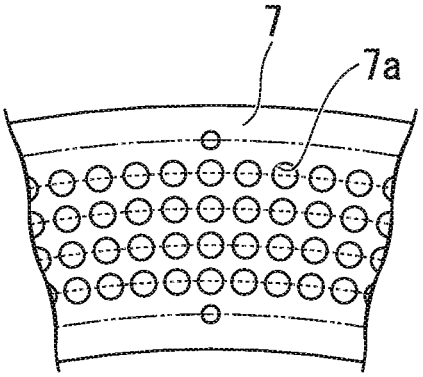
FIG. 4 is an enlarged view showing an arrangement of the pressure loss application unit of the embodiment of the present invention.
Figure 5:
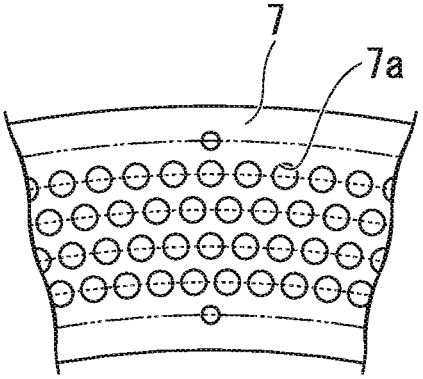
FIG. 5 is an enlarged view showing another aspect of the pressure loss application unit of the embodiment of the present invention, corresponding to FIG. 4.

In the above-mentioned embodiment, as shown in an enlarged view in FIG. 4, the case in which the through-holes 7*a* of the pressure loss application unit 7 are formed in four rows arranged at equal intervals in the circumferential direction and the through-holes 7*a* of the adjacent rows in the radial direction are disposed at the same position in the circumferential direction has been described. However, arrangement of the through-holes 7*a* is not limited to this arrangement. For example, like another aspect shown in FIG. 5, the through-holes 7*a* may be disposed in a zigzag disposition manner. Zigzag disposition means that the through-holes 7*a* are disposed at positions of halves of pitches between the through-holes 7*a* of the adjacent rows.

While the case in which the through-holes 7*a* are formed in four rows in the radial direction has been described, the through-holes 7*a* may be formed in five rows or more or three rows or less. The through-holes 7*a* are not limited to round holes. For example, through-holes 7*a* with polygonal shapes, other shapes, and or combinations of a plurality kinds of shapes may be used.

In the above-mentioned embodiment, the case in which the return flow path forming section 12 includes the diffuser unit 26 or the return vane 29 has been described. However, the diffuser unit 26 or the return vane 29 may be installed or may be omitted according to necessity. When the return flow path forming section 12 is not needed, the return flow path forming section 12 itself may be omitted.

In the above-mentioned embodiment, the case in which the discharge opening section 31 of the outlet space forming section 13 is formed at the same position as the introduction opening section 15 of the inlet space forming section 10 in the circumferential direction about the axis O has been described. In the above-mentioned embodiment, further, the case in which the introduction opening section 15 of the inlet space forming section 10 and the intermediate introduction opening section 22 through which a fluid is introduced into the interstage inflow inlet space 19 are formed at opposite sides having the axis O interposed therebetween has been described. However, the introduction opening section 15, the intermediate introduction opening section 22 and the discharge opening section 31 are not limited to this disposition as long as they are formed in a part in the circumferential direction about the axis O. However, like the above-mentioned embodiment, since the intermediate introduction opening section 22 through which the fluid is introduced into the interstage inflow inlet space 19 is disposed at a position different from positions of the introduction opening section 15 and the discharge opening section 31 in the circumferential direction about the axis O, an installation space for a flange or the like configured to fix a pipeline or the like connected to the intermediate introduction opening section 22 can be easily secured without enlarging a dimension of the casing 4 in the axis O direction.

INDUSTRIAL APPLICABILITY

The present invention can be applied to a centrifugal compression test device. According to the present invention, when performance prediction of a centrifugal compressor having interstage inflow is performed, a verification test having high reliability can be performed on a single stage impeller, and performance prediction accuracy can be improved.

REFERENCE SIGNS LIST

1 Centrifugal compression test device
2 Rotary shaft
2*a* First end portion
2*b* Second end portion
2*c* Outer circumferential surface
3A, 3B Bearing
4 Casing
5 Impeller
5*a* Disk
5*b* Blade
5*c* Cover
5*ca* Inner circumferential surface
6 Driving source
7 Pressure loss application unit
7*a* Through-hole
10 Inlet space forming section
11 Flow path forming section
12 Return flow path forming section
13 Outlet space forming section
14 Inlet space
14*a* First side surface
14*b* Second side surface
14*c* Inner circumferential surface
14*d* Outer circumferential edge
15 Introduction opening section
16 Introduction flow path
16*a* Opening section
17 Inlet flow path
18 Interstage inflow path
19 Interstage inflow inlet space
20 Inclined surface
21 Outer circumferential section
22 Intermediate introduction opening section
25 Flow path outlet
26 Diffuser unit
27 Return bend section
28 Straight flow path
29 Return vane
30 Outlet space
31 Discharge opening section

What is claimed is:

1. A single stage centrifugal compression test device comprising:

a rotary shaft extending in an axial direction;

a bearing rotatably support the rotary shaft about an axis of the rotary shaft;

a driving source that drives the rotary shaft around the axis;

an impeller fixed to an outer circumferential surface of the rotary shaft and configured to pump a fluid flowing from a first side in an axial direction to an outside in a radial direction while rotating together with the rotary shaft;

a flow path forming section comprising:

a curved introduction flow path that:

comprises an annular opening section that is provided at a front end of the curved introduction flow path and faces the first side of the impeller in the axial direction of the rotary shaft, and guides a fluid from the outside in the radial direction toward the inside in the radial direction by extending inward in the radial direction after curving from the annular opening section toward the inside of the flow path forming section, an inlet flow path connected to the introduction flow path and guides the fluid to the impeller from the first side in the axial direction, and an interstage inflow path extending from the outside toward the inside in the radial direction and connected to the inlet flow path at a second side of the introduction flow path in the axial direction; and an inlet space forming section having an introduction opening section through which a fluid is introduced from a part in the circumferential direction and outside in the radial direction at the first side of the introduction flow path in the axial direction, wherein the inlet space forming section forms an annular shape about the axis, and the inlet space forming section is connected to the annular opening section of the introduction flow path, and the annular opening section opens toward an inlet space of the inlet space forming section.

2. The single stage centrifugal compression test device according to claim 1, further comprising an annular shaped punching metal having through-holes, wherein the annular-shaped punching metal applies a pressure loss to a fluid flowing into the introduction flow path.

3. The single stage centrifugal compression test device according to claim 2, wherein the annular shaped punching metal is only installed, within the single stage centrifugal compression test device and in the circumferential direction of the axis of the rotary shat, at a side closer to the introduction opening section than the axis of the rotary shaft.

4. The single stage centrifugal compression test device according to claim 1, further comprising:

a return flow path forming section that forms a return flow path extending inward in the radial direction after extending from the impeller toward the outside in the radial direction; and an outlet space forming section through which a fluid is discharged from a part in the circumferential direction and the outside in the radial direction, forming an annular shape about the axis, and to which a rear end of the return flow path is connected, at a second side of the return flow path in the axial direction.

5. The single stage centrifugal compression test device according to claim 2, further comprising:

a return flow path forming section that forms a return flow path extending inward in the radial direction after extending from the impeller toward the outside in the radial direction; and an outlet space forming section through which a fluid is discharged from a part in the circumferential direction and the outside in the radial direction, forming an annular shape about the axis, and to which a rear end of the return flow path is connected, at a second side of the return flow path in the axial direction.

6. The single stage centrifugal compression test device according to claim 3, further comprising:

a return flow path forming section that forms a return flow path extending inward in the radial direction after extending from the impeller toward the outside in the radial direction; and an outlet space forming section through which a fluid is discharged from a part in the circumferential direction and the outside in the radial direction, forming an annular shape about the axis, and to which a rear end of the return flow path is connected, at a second side of the return flow path in the axial direction.

7. The single stage centrifugal compression test device according to claim 1, wherein the interstage inflow path extends along an extending direction of the introduction flow path from the outside toward the inside in the radial direction.

* * * * *